United States Patent [19]

Tseng

[11] Patent Number: 4,874,016

[45] Date of Patent: Oct. 17, 1989

[54] METHOD FOR IMPROVING SIGNAL-TO-NOISE RATIOS IN FLUIDIC CIRCUITS AND APPARATUS ADAPTED FOR USE THEREWITH

[75] Inventor: Raymond R. Tseng, Tempe, Ariz.

[73] Assignee: Allied-Signal Inc., Phoenix, Ariz.

[21] Appl. No.: 318,094

[22] Filed: Feb. 28, 1989

[51] Int. Cl.[4] ..... F15C 1/08

[52] U.S. Cl. ..... 137/826; 137/819; 137/820; 137/833; 181/233

[58] Field of Search ..... 137/805, 819, 820, 826, 137/833; 138/26; 244/78

[56] References Cited

U.S. PATENT DOCUMENTS

| | | | |
|---|---|---|---|
| 2,233,804 | 3/1941 | Bourne | 181/233 |
| 2,766,840 | 10/1956 | Munroe | 181/233 |
| 2,936,790 | 5/1960 | Dahl et al. | 181/233 |
| 3,061,039 | 10/1962 | Peters | 181/233 |
| 3,148,745 | 9/1964 | Jones | 181/233 |
| 3,398,758 | 8/1968 | Unfried | 137/828 |
| 3,780,769 | 12/1973 | Posingies | 137/819 |
| 3,857,412 | 12/1974 | Ringwall | 137/826 |
| 3,957,234 | 5/1976 | Mulvey et al. | 137/819 |
| 4,258,754 | 3/1981 | Pickett | 137/819 |
| 4,467,984 | 8/1984 | Tippetts | 244/78 |
| 4,497,388 | 2/1985 | Dexter | 181/233 |
| 4,514,151 | 4/1985 | Anders et al. | 417/540 |
| 4,671,380 | 6/1987 | Henderson et al. | 181/233 |

OTHER PUBLICATIONS

"A Chemical Agent Calibrator Using Fluidic Oscillator Flowmeters" by John P. Grills, Chester W. Ross, U.S. Army Laboratory Command, Harry Diamond Laboratories, Adelphi, MD 20/83-1197.

*Primary Examiner*—A. Michael Chambers

*Attorney, Agent, or Firm*—Joseph R. Black; James W. McFarland

[57] ABSTRACT

A fluidic circuit (10) having two oscillators (22,24) which separately vent to a common volume (78) and receive pressurized fluid inputs along separate flow paths (54,56) is provided with filters (80) positioned both upstream and downstream from each oscillator. Each of the filters (80) is adapted to attenuate oscillator-induced noise and comprises a series combination of an inductive element (82), a capacitive element (84), and an inductive element (86).

17 Claims, 4 Drawing Sheets

METHOD FOR IMPROVING SIGNAL-TO-NOISE RATIOS IN FLUIDIC CIRCUITS AND APPARATUS ADAPTED FOR USE THEREWITH

The disclosure of U.S. Pat. No. 4,467,984 Tippetts (hereinafter, "the '984 patent") is incorporated herein by reference.

TECHNICAL FIELD

This invention relates generally to fluidic circuits and more particularly to those having two oscillators which receive fluidic input signals along separate flow paths, and having separate vent paths extending from each oscillator to a common vent. Still more specifically, the invention relates to circuits of the above description which incorporate low-pass filters both upstream and downstream from the oscillators.

BACKGROUND OF THE INVENTION

Fluidic circuits are used in a variety of applications where it is desired to measure some physical attribute by taking advantage of the correlation between information outputted from the circuit and the pressure or flow rate effects produced therein by the attribute in question. Typically, the circuit comprise a power source (i.e. a source of pressurized fluid such as a pump), at least one sensing element that responds to a change in the attribute (i.e. performs a data acquisition function in the circuit), and other elements that collectively respond to the fluidic output of the sensing element in order to provide information in a form which is suitable for downstream processing (i.e. perform a data conditioning function in the circuit). Output signals (i.e. pressures or flow rates) of a fluidic circuit may be used to directly actuate a control mechanism designed to respond to a change in hydraulic force, but are often used to drive a transducer so that the underlying information is provided in an electronic form more suitable for higher-level control. In the latter uses, the circuit typically comprises two fluidic oscillators used as pressure-to-frequency converters, each receiving as its input a fluidic signal originating in one of two receiving channels of the sensing element and communicated through one or more fluidic amplifiers, and each producing a fluidic wavetrain as its output. The frequency of the wavetrain depends on the magnitude of the fluidic input signal, and the data to be correlated with the pertinent physical attribute are differential frequency values of the wavetrains. The performance of such circuits is adversely affected by pressure-wave interference in vent passages connected to both oscillators and in flow passages through which the fluidic input signals are communicated to the oscillators. Over a given range of frequency differentials on either side of zero, this interference results in a "lock-on" phenomenon in which it appears that one wavetrain is effectvely stretched or contracted to match the frequency of the other. Consequently, resolution of values for the pertinent physical attribute is severely impaired over a range associated with the aforementioned range of frequency differentials. In addition, noise from each oscillator may be communicated upstream to the last-stage amplifier. This noise may adversely affect the fluidic signals outputted from the amplifier and the performance of the amplifier itself. Consequently, the quality and accuracy of the pressure signals inputted to the oscillators may be impaired.

The above-described problems are particularly pronounced in applications where the allowable space for the circuit is very limited, thus requiring that the oscillators and other circuit elements be positioned in close proximity to each other (e.g. fluidic angular rate sensing systems for guided missiles). Moreover, when the pump is of a type which provides an alternating flow rate, it may become an additional source of noise in such applications.

Publication HDL-TM-88-2 entitled "A Chemical Agent Calibrator Using Fluidic Oscillator Flowmeters" addresses the problem of oscillator noise in a fluidic circuit used in chromotography applications. The authors suggest that satisfactory results may be obtained by providing a fluidic low-pass filter in the feedback channel of a multi-stage oscillator, in combination with electronic filtering of the transducer output signals. It is asserted that fluidic filtering alone is inadequate due to loading constraints imposed by the fluidic circuitry (page 11, fourth paragraph). Interference between oscillators and potential interference from the source are not addressed.

The present invention exploits the discovery that in fluidic circuits of the type generally described above, a significant portion (estimated at 20–30 percent) of the noise created by operation of the oscillators manifests itself upstream from the oscillators. This and further discoveries in connection with the present invention provide for remarkably improved attenuation of oscillator-induced noise without sacrifice of overall circuit performance.

An objective of the invention is to improve resolution in fluidic measurement systems gradually, and in angular rate sensing systems in particular.

Another objective of the invention is to provide higher signal-to-noise ratios in fluidic circuits which employ oscillators.

These and such further objectives as are evidenced herein will be apparent from the following description, which includes the appended claims and accompanying drawings.

SUMMARY OF THE INVENTION

The invention provides significantly improved noise attenuation for fluidic circuits having oscillators that vent to a common volume and receive input fluid along separate flow paths. This improved attenuation provides significantly improved resolution and accuracy in measurement systems which employ such circuits. In broad terms, the improved attenuation is achieved by providing filters both upstream and downstream from each oscillator, the filters being adapted to attenuate oscillator-induced noise.

In an improvement on the invention, each filter is provided in the form of a series combination of an inductive element, a capacitive element, and an inductive element. A filter configured with these circuit elements appears to provide far more attenuation than can be expected from elements conventionally employed in fluidics as high-frequency attenuators.

In an improvement on the aforementioned improvement, the inductive elements of the filter are provided in the form of flow passages having lengths that are selected so that the filter attenuates oscillator-induced noise while avoiding noise attributable to resonance of the filter.

DESCRIPTION OF THE PREFERRED EMBODIMENT

Figure 1:
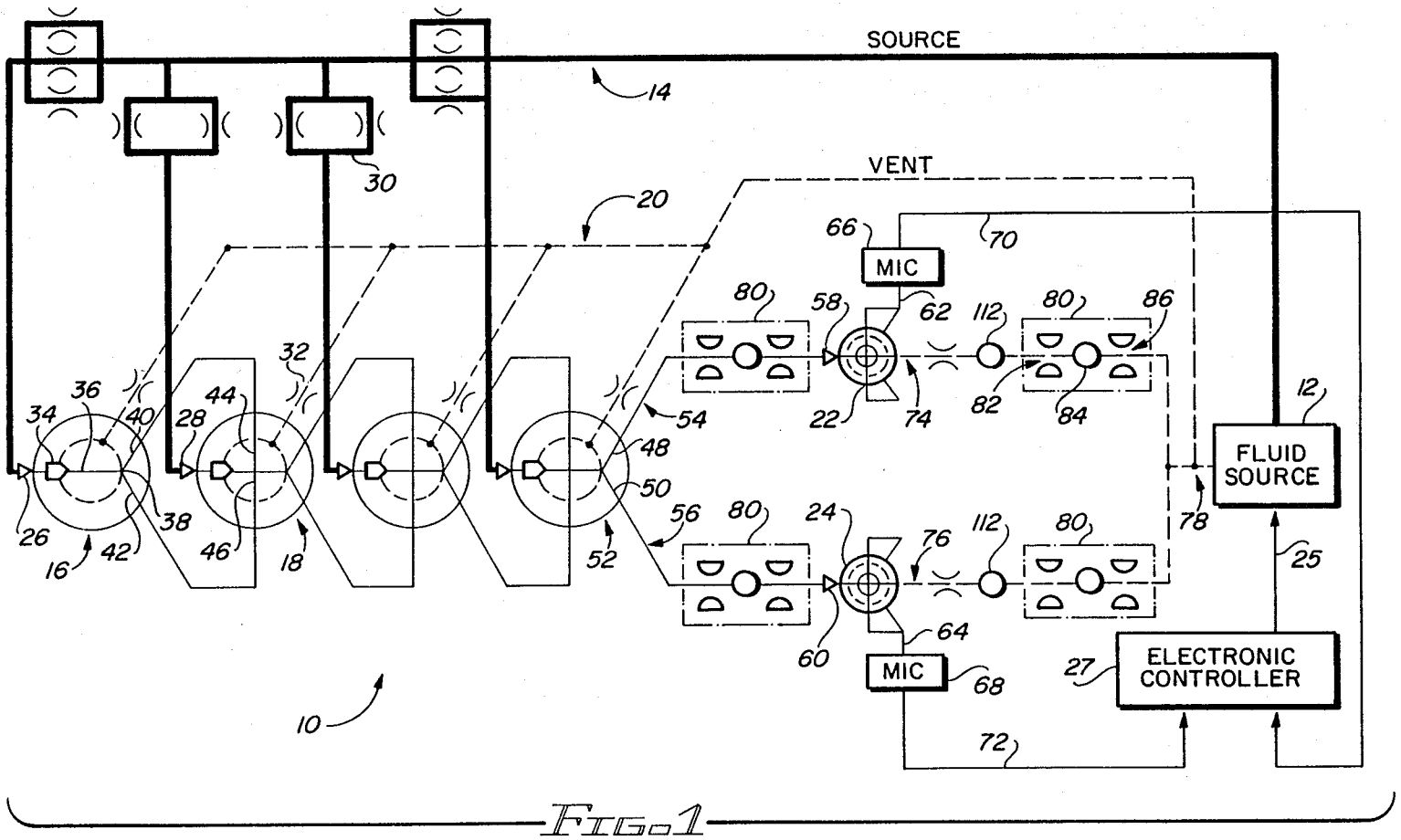
FIG. 1 is a schematic drawing of a fluidic circuit which incorporates the invention.
Figure 2A:
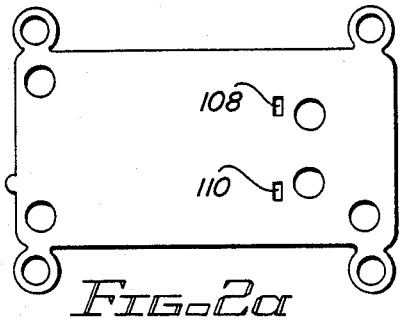
FIGS. 2 and 3 are top elevational views of a plurality of laminates and illustrate partial stacking sequences for an angular rate sensor incorporating the preferred embodiment of the invention.
Figure 2E:
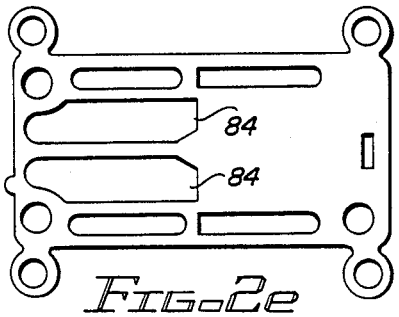
Figure 2B:
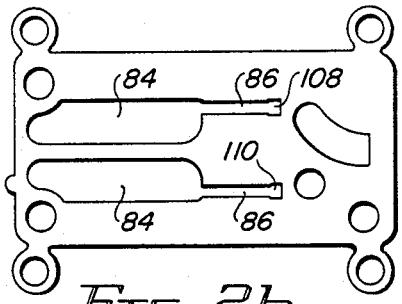
Figure 2F:
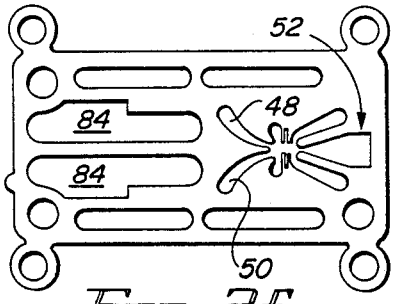
Figure 2C:
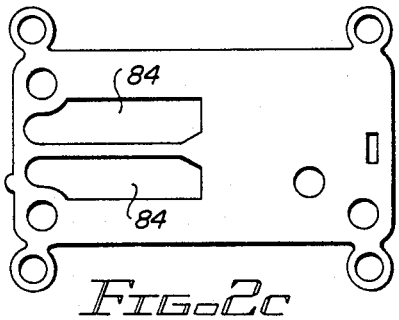
Figure 2G:
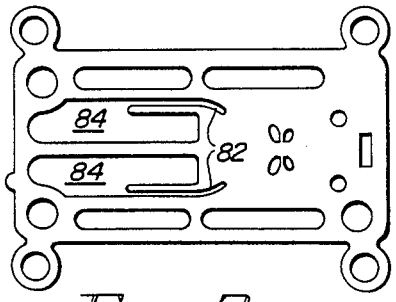
Figure 2D:
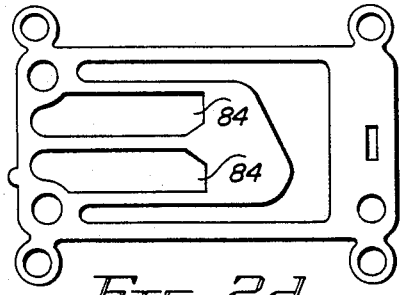
Figure 2H:
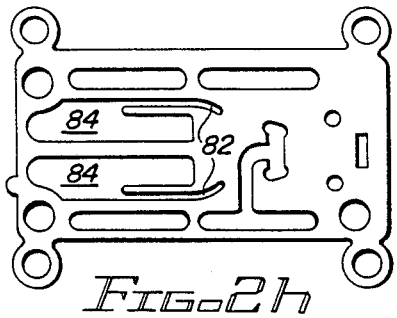
Figure 3A:
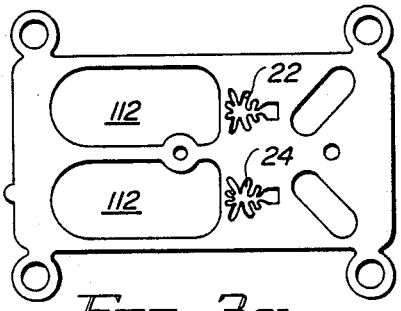
Figure 3E:
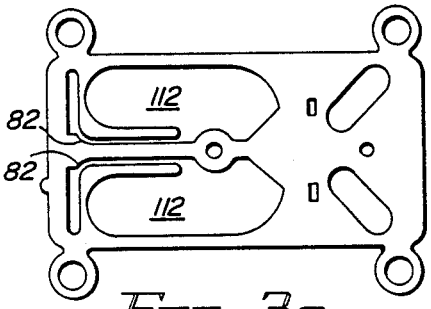
Figure 3B:
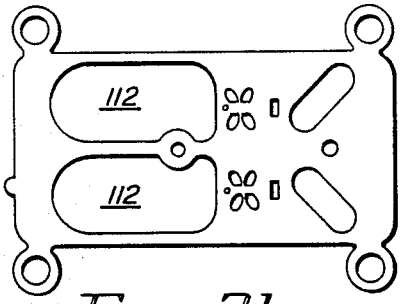
Figure 3F:
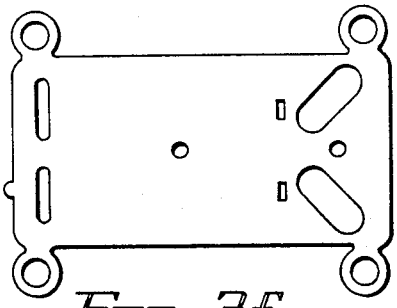
Figure 3C:
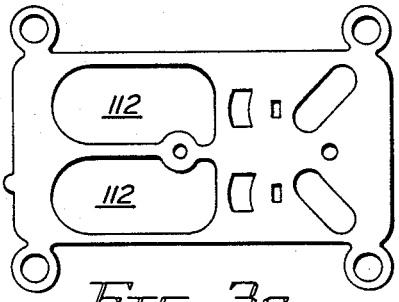
Figure 3G:
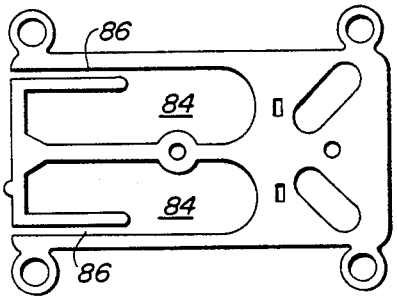
Figure 3D:
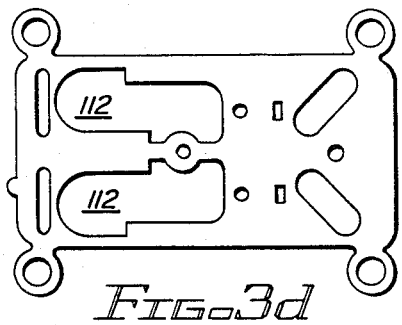

The schematic diagram of FIG. 1 illustrates a fluidic circuit 10 in which a source 12 of pressurized fluid supplies the fluid via a supply network 14 (indicated by bold lines) to a fluidic sensor element 16 and a plurality of fluidic amplifiers (as at 18). The source 12 is preferably a piezoelectric pump such as that described in U.S. Pat. No. 4,648,807 Tippetts, et al. The source 12 receives fluid via a vent network 20 (indicated by dashed lines) connecting the source to the sensor 16, the amplifier 18, and fluidic oscillators 22,24. Typically, the circuit 10 is operated as a closed system in which the fluid is continually recirculated. The source 12 is actuated in response to electrical signals (represented by line 25) communicated thereto by a controller 27. Fluid is delivered to the inlet 26 of the sensor 16 and to those (as at 28) of the amplifier 18 at pressures suitable for each, as set by parallel combinations (as at 30) of resistors provided for each branch of the supply network 14. Venting is achieved by providing pressure differentials set by resistors (as at 32) included in each branch of the vent network 20.

The particular physical attribute that the sensor 16 is designed to measure, the particular design of the sensor, and the presence or absence of a fluidic circuit element which would be considered a sensor are unimportant considerations since the advantages provided by the present invention relate to noise attenuation and are applicable to any fluidic circuit in which at least two oscillators vent to a common volume and receive fluidic inputs along separate flow paths leading from a circuit element with which both oscillators are in fluid communication (e.g. at last-stage amplifier). For purposes of describing the invention as embodied in the best application thereof which is currently contemplated, the sensor 16 may be considered the main sensing laminate of an angular rate sensor such as that described in the '984 patent, and the circuit 10 may be considered one of three similar circuits which collectively make up the electrofluidic angular rate sensing system described in that patent, as modified by the teaching contained herein.

Fluid entering the inlet 26 of the sensor 16 is discharged through a nozzle 34, and directed along a flow axis 36 toward a splitter 38 positioned between two receiving channels 40,42. Amplification proceeds in the conventional manner, the fluid flowing into the receiving channels 40,42 being outputted therefrom as fluidic signal inputs to the control ports 44,46 of a first-stage amplifier 18, and so on, until amplified fluidic signals are outputted from the receiving channels 48,50 of a last-stage amplifier 52 along separate flow paths 54,56. The flow paths 54,56 extend to the inlets 58,60 of separate pressure-controlled oscillators 22,24. Each oscillator outputs a pressure wavetrain having a frequency that depends on the fluid pressure received at its input via its respective flow path (54 or 56). The output signal is communicated along closed paths 62,64 to transducers 66,68 (typically, miniature microphones) and converted to electrical frequency signals which are communicated along wires 70,72 to the controller 27. The difference between the frequencies of the signals communicated from the transducers 66,68 is proportional to the rate of rotation of the sensor 16 about an axis which is normal thereto. Fluid is vented from the oscillators 22,24 along separate vent paths 74,76 extending from the oscillators to a common vent 78 which is in communication with the source 12.

Interposed in each of the flow paths 54,56 between the last-stage amplifier 52 and the associated oscillator, and in each of the vent paths 74,76 between the associated oscillator and the common vent 78 is a low-pass filter 80. In the preferred embodiment of the invention, the filter 80 comprises a series combination of an inductive element (as at 82), a capacitive element (as at 84), and an inductive element (as at 86). A filter thus configured will be referred to hereinafter as an "L-C-L" filter. An "inductive element" as used in accordance with the present invention is a relatively narrow flow passage that has the following inherent or operational characteristics: 1) a length greater than that attributable to a mere orifice, thus providing inertially-dominated flow characteristics, 2) a cross-sectional flow area that is small in relation to cross-sectional flow areas directly on either side of the passage, and 3) the capability of inducing a pressure change that tends to resist a change in flow rate. The capacitive element 84 is preferably a fixed volume but may be any conventional mechanism for providing capacitance in a fluidic circuit.

Partial stacking sequences for an angular rate sensor incorporating the present invention are shown in FIGS. 2 and 3. Laminate "f" of FIG. 2 shows the receiving channels 48,50 of the last-stage amplifier 52. The low-pass filters 80 interposed in the flowpaths 54,56 (FIG. 1) are embodied in laminates "b" through "h". Laminates "a" and "b" show ports 108,110. Similar ports aligned in a series of laminates (including laminates "b" through "g" of FIG. 3, but otherwise not shown for laminates between "a" of FIG. 2 and "g" of FIG. 3) provide those portions of the flow paths 54,56 extending between the inductors 86 and the oscillators 22,24. Laminates "a" through "c" of FIG. 3 embody the oscillators 22,24. The low-pass filters 80 interposed in the vent paths 74,76 (FIG. 1) are embodied in laminates "e" through "g" of FIG. 3. Testing has shown that venting from the oscillators 22,24 directly to an inductive element produces a high degree of nonlinearity in the relationship between the input pressure and the output frequency of the oscillators 22,24. Capacitors 112 are provided in each vent path to compensate for this effect. As is indicated in FIG. 3, the additional capacitors 112 are interposed between the oscillators 22,24 and the first inductive element 82.

Figure 4:
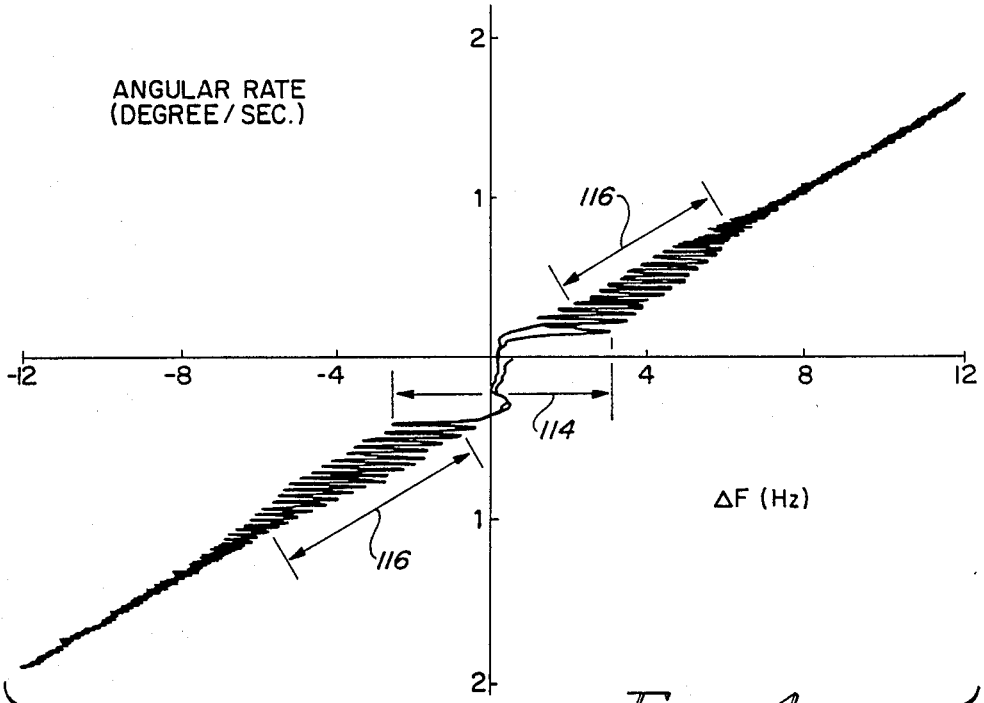
FIGS. 4 and 5 are graphs illustrating comparative performances of angular rate sensing circuits which employ different elements as low-pass filters.
Figure 5:
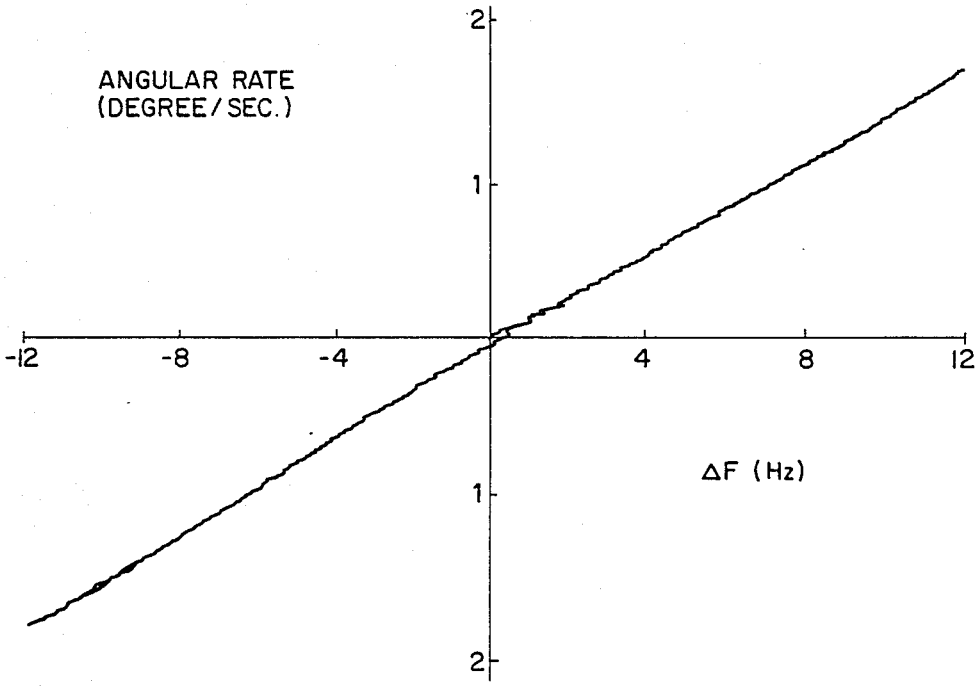

The forementioned improvements on the invention were tested in an angular rate sensing circuit designed to operate with an oscillator frequency range of from 1200 to 3400 hertz. Fluid was supplied by a piezoelectric pump operating at a frequency of about 3500 hertz. The graph of FIG. 4 (angular rate versus frequency differential) illustrates the performance of the circuit with destructive interference filters (in the vent pahs 74,76) and vortex diodes (in the flow paths 54,56) employed as high-frequency attenuators. FIG. 5 illustrates performance for the same kind of circuit with L-C-L filters 80 in all four paths. Comparing FIGS. 4 and 5, it can be see that there is still a significant range 114 over which resolution of angular rate is lost with the destructive interference filter/vortex diode combination, and that this range becomes relatively insignificant when L-C-L filters are employed. Moreover, the relatively noisy regions 116 of FIG. 4 arepractically undetectable in FIG. 5.

The length of the inductive elements 82,86 appears to be a very significant design parameter. Generally, increased attenuation of oscillator-induced noise is observed with increases in inductor length. However, the resonant frequency of the L-C-L filter is related to the lengths of the inductors, and the advantage to be gained from increasing inductor length is at some point compromised by noise attributable to resonance of the filter. Accordingly, the lengths of the inductive elements 82,86 should be fixed so that oscillator-induced noise is sufficiently attenuated while noise attributable to resonance of the L-C-L filter is substantially avoided. It appears that this condition will obtain if the lengths are sufficiently short in relation to the wavelength associated with the maximum frequency over which the oscillators operate in a given circuit design. The lengths of the inductive elements 82,86 in the circuit for which test results are indicated in FIG. 5 was approximately fifteen percent of the speed of sound in air divided by the highest oscillator frequency, 3400 hertz.

The reader should understand that the description herein is not intended to restrict the invention in such manner that its scope is defined by the preferred embodiment or to specific details thereof. Accordingly, the scope of the invention should be viewed in the broadest manner which is consistent with the following claims and their equivalents.

What is claimed is:

1. A fluidic circuit having a last-stage fluidic amplifier from which fluidic outputs are communicated along two separate flow paths to two separate fluidic oscillators, said circuit being adapted to vent fluid from said oscillators along two initially separate vent paths, said vent paths leading to a common vent, said circuit having circuit elements comprising:

a first low-pass filter interposed in one of said flow paths between said last-stage amplifier and one of said oscillators;

a second low-pass filter interposed in the other of said flow paths between said last-stage amplifier and the other of said oscillators;

a third low-pass filter interposed in one of said vent paths between said one oscillator and said common vent; and a fourth low-pass filter interposed in the other of said vent paths between the other of said oscillators and said common vent.

2. A fluidic circuit as recited in claim 1 wherein said filters are adapted to attenuate pressure waves resulting from operation of said oscillators.

3. A fluidic circuit as recited in claim 2 wherein said filters are adapted to attenuate pressure waves resulting from operation of said oscillators while substantially avoiding noise resulting from resonance of said filters.

4. A fluidic circuit as recited in claim 2 wherein each of said low-pass filters comprise a series combination of an inductive element, a capacitive element, and a inductive element.

5. A fluidic circuit as recited in claim 4 wherein each of said inductive elements comprises a flow passage having a fixed length, said flow passage having a cross-sectional flow area that is small in relation to cross-sectional flow areas of other flow passages or circuit elements which are directly upstream or downstream from said inductive elements.

6. A fluidic circuit as recited in claim 5 wherein said filters are adapted, by means including said fixed length, to attenuate noise resulting from operation of said oscillators while substantially avoiding noise which is attributable to resonance of said filters.

7. A fluidic circuit as recited in claim 6 wherein said fixed length is about fifteen percent of a wavelength associated with a highest frequency in a range of frequencies over which said oscillators are designed to oscillate.

8. A fluidic circuit as recited in claim 7 further comprising:

a fluidic sensor element having an inlet, a nozzle, two receiving channels, and a splitter positioned between said receiving channels, said sensor element defining a flow axis extending from said nozzle to said splitter, said sensor element being in fluid communication with said last-stage amplifier via at least one additional fluidic amplifier; and a source of pressurized fluid for supplying fluid to said circuit at an alternating flow rate, said source being in fluid communication with and supplying fluid to said inlet of said sensor element and to inlets of all fluidic amplifiers in communication with said sensor element, said source being in fluid communication with and receiving fluid from said common vent.

9. A fluidic circuit as recited in claim 8 wherein said sorce is a piezoelectric pump adapted to operate at a frequency no lower than a lowest of said range of frequencies.

10. A fluidic circuit that comprises:

two separate fluidic oscillators;

two separate flow paths, each leading to an inlet of one of said oscillators;

two separate vent paths, each leading from one of said oscillators to a common vent;

means interposed in each of said flow paths for attenuating noise resulting from operation of said oscillators; and means interposed in each of said vent paths for attenuating noise resulting from operation of said oscillators.

11. A fluidic circuit as recited in claim 10 wherein said attenuating means interposed in each vent path comprises a series combination of an inductive element, a capacitive element, and an inductive element.

12. A fluidic circuit as recited in claim 10 wherein said attenuating means interposed in each flow path comprises a series combination of an inductive element, a capacitive element, and an inductive element.

13. A fluidic circuit as recited in claim 10 wherein each of said attenuating means comprises a series combination of an inductive element, a capacitive element, and an inductive element.

14. A fluidic circuit as recited in claim 13 wherein said attenuating means are adapted, by means including fixing the lengths of said inductive elements, to attenuate said noise while substantially avoiding noise attributable to resonance of said series combinations.

15. In a fluidic measurement system which employs a last-stage fluidic amplifier having two receiving channels, each of said receiving channels being in fluid communication with a separate oscillator via a separate flow path, said oscillators being in communication with a common vent via separate vent paths, said circuit passing fluidic signals between said receiving channels and said oscillators, a method for improving a signal-to-noise ratios in said circuit comprising the steps of:

in each of said separate flow paths, attenuating noise that results from operation of said oscillators; and in each of said vent paths, attenuating noise that results from operation of said oscillators.

16. A method as recited in claim 15 wherein each of said attenuating steps is performed by passing fluid through a series combination of an inductive element, a capacitive element, and an inductive element.

17. A method as in claim 16 wherein each of said inductive elements comprise a flow passage having a fixed length, and wherin said fixed length is selected so that said series combination attenuates noise resulting from operation of said oscillators while substantially avoiding noise that is attributable to resonance of said series combination.

* * * * *

UNITED STATES PATENT AND TRADEMARK OFFICE

CERTIFICATE OF CORRECTION

PATENT NO. : 4,874,016

DATED : 10/17/89

INVENTOR(S) : RAYMOND R. TSENG

It is certified that error appears in the above-identified patent and that said Letters Patent is hereby corrected as shown below:

In Column 1, line 26 "comprise" should be changed to the plural -- comprises --.

In Column 1, line 57, correct spelling of "effectvly" to -- effectively --.

In Column 2, line 34, "gradually" should be replaced with -- generally --.

In Column 3, line 30, "amplifier" should be changed to the plural -- amplifiers --.

In Column 5, line 3, "see" should be changed to -- seen --.

In Column 5, line 8, "arepractically" should appear as two separate words -- are practically --.

Col.5, In Claim 4, line 66, "comprise" should be changed to the plural -- comprises --.

UNITED STATES PATENT AND TRADEMARK OFFICE

CERTIFICATE OF CORRECTION

PATENT NO. : 4,874,016

DATED : 10/17/89

INVENTOR(S) : RAYMOND R. TSENG

It is certified that error appears in the above-identified patent and that said Letters Patent is hereby corrected as shown below:

Col.6, In Claim 9, line 37, "sorce" should be changed to -- source --.

Col.7, In Claim 15, line 10 the word "a" that appears after the word 'improving' should be deleted.

Col. 8, In Claim 17, line 8, "comprise" should be changed to the plural -- comprises --.

Col.8, In Claim 17, line 9 "wherin" should be corrected to read -- wherein --.

Signed and Sealed this

Eleventh Day of September, 1990

*Attest:*

HARRY F. MANBECK, JR.

*Attesting Officer*

*Commissioner of Patents and Trademarks*